US005548520A

United States Patent [19]

Nakamura et al.

[11] Patent Number: 5,548,520

[45] Date of Patent: Aug. 20, 1996

[54] BREAKOUT PREDICTION SYSTEM IN A CONTINUOUS CASTING PROCESS

[75] Inventors: Tsuyoshi Nakamura, Tokyo; Kazuho Kodaira, Kanagawa; Katsuhiro Higuchi, Ehime, all of Japan

[73] Assignees: Topy Kogyo Kabushiki Kaisha; Sumitomo Heavy Industries, Ltd., both of Tokyo, Japan

[21] Appl. No.: 363,352

[22] Filed: Dec. 23, 1994

[30] Foreign Application Priority Data

Dec. 24, 1993 [JP] Japan ..... 5-327851

[51] Int. Cl.[6] ..... B22D 11/16

[52] U.S. Cl. ..... 364/472.02; 164/451.000; 164/151.500; 364/476.01; 395/912.000

[58] Field of Search ..... 364/472, 476, 364/510; 395/904, 906, 911, 912, 914, 21; 164/450.3, 451, 452, 453, 151.4, 151.5, 154.1, 450.3

[56] References Cited

U.S. PATENT DOCUMENTS

| | | | |
|---|---|---|---|
| 4,556,099 | 12/1985 | Yamamoto et al. | 164/451 |
| 4,774,998 | 10/1988 | Matsushita et al. | 164/453 |
| 4,949,777 | 8/1990 | Itoyama et al. | 164/453 |
| 5,020,585 | 6/1991 | Blazek et al. | 164/452 |

OTHER PUBLICATIONS

"Prediction System For Predicting Breakout in Continuous Casting by Neutral Network Technique", Seitetsu Kenkyuu, vol. 399, pp. 31–34, 1990.

"Applied Neutral Network Techniques in Illustrative Cases", published by Triceps Corporation, Apr. 24, 1992, pp. 13–24.

"Fundamental Theory of Neuro–Computing", published by Kaibundo Publishing Co., Ltd., pp. 2–3, bearing a date Dec. 10, 1990.

*Primary Examiner*—Roy N. Envall, Jr.
*Assistant Examiner*—Steven R. Garland
*Attorney, Agent, or Firm*—Burns, Doane, Swecker & Mathis, L.L.P.

[57] ABSTRACT

In a breakout prediction system for predicting breakout in a mold of a continuous casting machine, a prediction deciding section is connected to one of temperature sensors located on the mold and at least three temperature sensors which are adjacent to the one of the temperature sensors. In the prediction deciding section, at least three cross-correlators are connected to the one of the temperature sensors and the at least three temperature sensors and carry out a predetermined normalization operation to produce operation results. A temperature variation pattern detector is connected to the one of the temperature sensors to detect a temperature variation pattern. At least three peak detectors are connected to the at least three cross-correlators, respectively, to detect peak values of the operation results. At least three breakout detection networks are supplied with the peak values and the temperature variation pattern to carry out decision on breakout prediction. An alarm producing unit produces an alarm when one of outputs of the at least three breakout detection networks exceeds a predetermined threshold level.

2 Claims, 5 Drawing Sheets

BREAKOUT PREDICTION SYSTEM IN A CONTINUOUS CASTING PROCESS

BACKGROUND OF THE INVENTION

This invention relates to a breakout prediction system in a continuous casting process.

In the continuous casting process, molten iron reserved in a casting ladle is poured through a tundish into a mold, as well known in the art. The molten iron in the mold is gradually cooled and solidified to be drawn out from a lower portion of the mold as a strand. When the molten iron is cooled within the mold, a solidified portion called a shell is formed on a surface of the molten iron that is in contact with an internal wall of the mold. The continuous casting process suffers from a serious problem that the shell in the mold is often cracked or broken due to various factors. When a cracked portion of the shell reaches a bottom of the mold, the molten iron in the shell leaks out from the mold. Such an accident is called "breakout". Occurrence of the breakout results in interruption of the continuous casting process and must be avoided. In order to avoid occurrence of the breakout, it is required to detect presence of the cracked portion in the shell. Upon detection of the presence, the cracked portion is solidified again by decreasing an operation speed in drawing the strand.

When the shell is cracked in the mold, the mold and the molten iron are brought into direct contact with each other. As a consequence, the temperature of a mold wall is increased at a site corresponding to the cracked portion of the shell. In a surrounding area adjacent to the cracked portion of the shell, the temperature is increased through heat transmission from the cracked portion after a certain delay from occurrence of the cracked portion. Taking the above into consideration, a conventional breakout prediction system carries out prediction of the breakout by the use of a number of temperature sensors located on the mold wall for monitoring a temperature variation pattern of the mold wall to detect presence of the cracked portion in the shell.

A first example of such a conventional breakout prediction system is disclosed in a technical report entitled "Prediction System for Predicting Breakout in Continuous Casting by Neural Network Technique" contributed to Seitetsu Kenkyuu (=Iron Works Study), Vol. 399, pp. 31–34, 1990. A second example is disclosed in a book entitled "Applied Neural Network Techniques in Illustrative Cases" published by Triceps Corporation on Apr. 24, 1992, pp. 13–24.

In the first example, however, consideration is insufficient to the temperature variation pattern observed in the surrounding area adjacent to the cracked portion of the shell after the certain delay from occurrence of the cracked portion. Therefore, restriction is imposed on an improvement of precision in breakout prediction. In the second example, the prediction system has a complicated structure although the above-mentioned disadvantage in the first example is taken into consideration.

SUMMARY OF THE INVENTION

It is therefore a principal object of this invention to provide a breakout prediction system which is capable of immediately predicting occurrence of breakout with a high precision.

It is another object of this invention to provide a breakout prediction system which has a simplified structure.

A breakout prediction system to which this invention is applicable is for predicting breakout in a mold of a continuous casting machine with reference to detection signals produced from a plurality of temperature sensors located on the mold. According to this invention, the temperature sensors are grouped into a plurality of units each of which comprises one of the temperature sensors and at least three adjacent temperature sensors adjacent to the one of the temperature sensors. Each unit is connected to a corresponding one of a plurality of prediction deciding sections. Each prediction deciding section comprises at least three cross-correlators which correspond to the at least three adjacent temperature sensors, respectively, and each of which is responsive to a detection signal from a corresponding one of the adjacent temperature sensors and a detection signal from the one of the temperature sensors and carries out a predetermined normalization operation and a cross-correlation operation to produce an operation result, a temperature variation pattern detector supplied with the detection signal from the one of the temperature sensors for detecting a temperature variation pattern indicative of a time sequential variation of a temperature, at least three peak detectors which are connected to the at least three cross-correlators, respectively, and each of which is for detecting a peak value of the operation result, and at least three breakout detection networks each of which is supplied with an output of a corresponding one of the at least three peak detectors and an output of the temperature variation pattern detector and carries out decision on breakout prediction. The system further comprises an alarm producing unit for producing an alarm when one of outputs of the at least three breakout detection networks exceeds a predetermined threshold level.

DESCRIPTION OF THE PREFERRED EMBODIMENT

Figure 1:
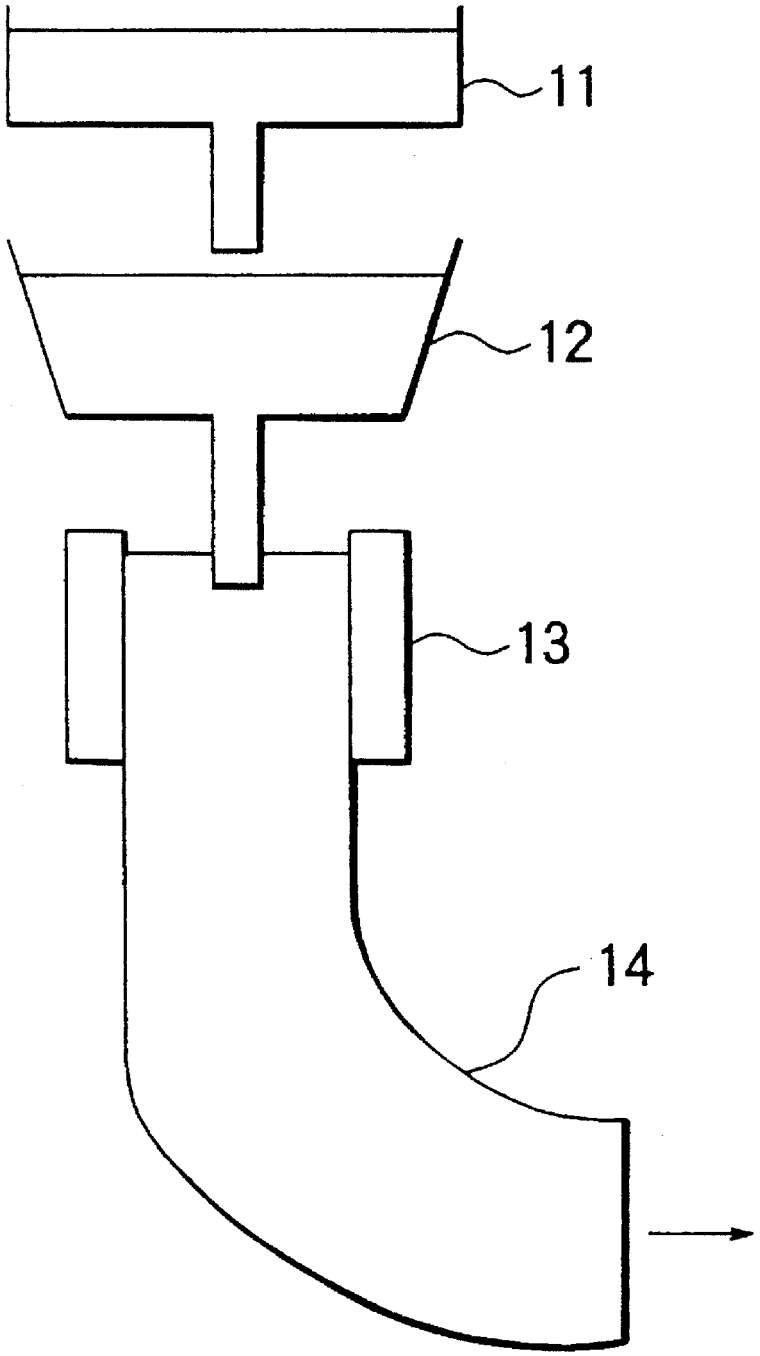
FIG. 1 is a view for describing a continuous casting process.

Referring to FIG. 1, description will be made as regards an outline of a continuous casting process to which this invention is applicable. In FIG. 1, molten iron reserved in a casting ladle 11 is poured through a tundish 12 into a mold 13. The molten iron in the mold 13 is gradually cooled and solidified to be drawn out from a lower portion of the mold 13 as a strand 14.

Figure 2:
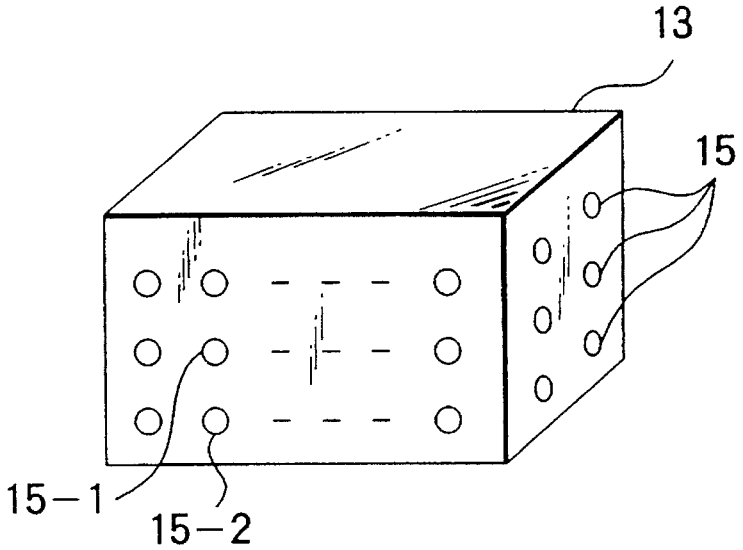
FIG. 2 is a view illustrating an exemplified arrangement of temperature sensors embedded in a mold.

Referring to FIG. 2, a plurality of thermocouple elements 15 acting as temperature sensors are embedded in an outer wall of the mold 13 at a predetermined interval from one another. It is assumed here that a shell or a solidified portion formed on a surface of the molten iron is cracked in the mold 13. In this event, a detected temperature detected by a particular one of the thermocouple elements 15 that is placed at a corresponding position, for example, the thermocouple element 15-1 is varied along a solid line curve illustrated in FIG. 3. On the other hand, the thermocouple element 15-2 below the thermocouple element 15-1 detects a temperature variation as depicted by a dashed line curve in FIG. 3.

Figure 3:
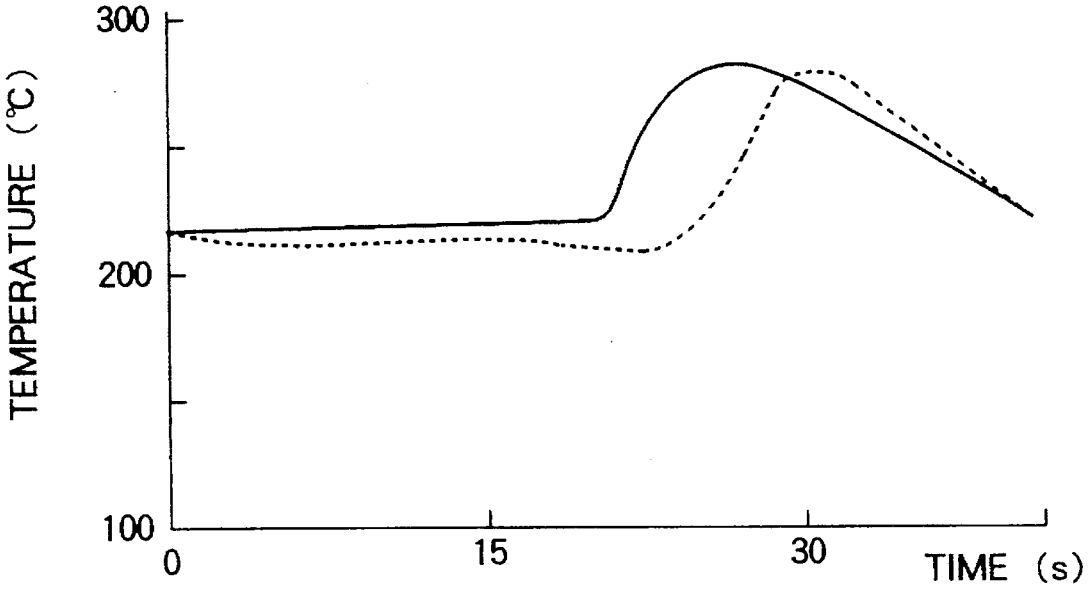
FIG. 3 is a view illustrating typical temperature variation patterns observed at two adjacent positions of the mold upon occurrence of breakout.

A breakout prediction system according to this invention carries out breakout prediction, relying upon temperature variation patterns as those depicted by the solid line curve and the dashed line curve in FIG. 3. Detailed description will hereinafter be given.

Figure 4:
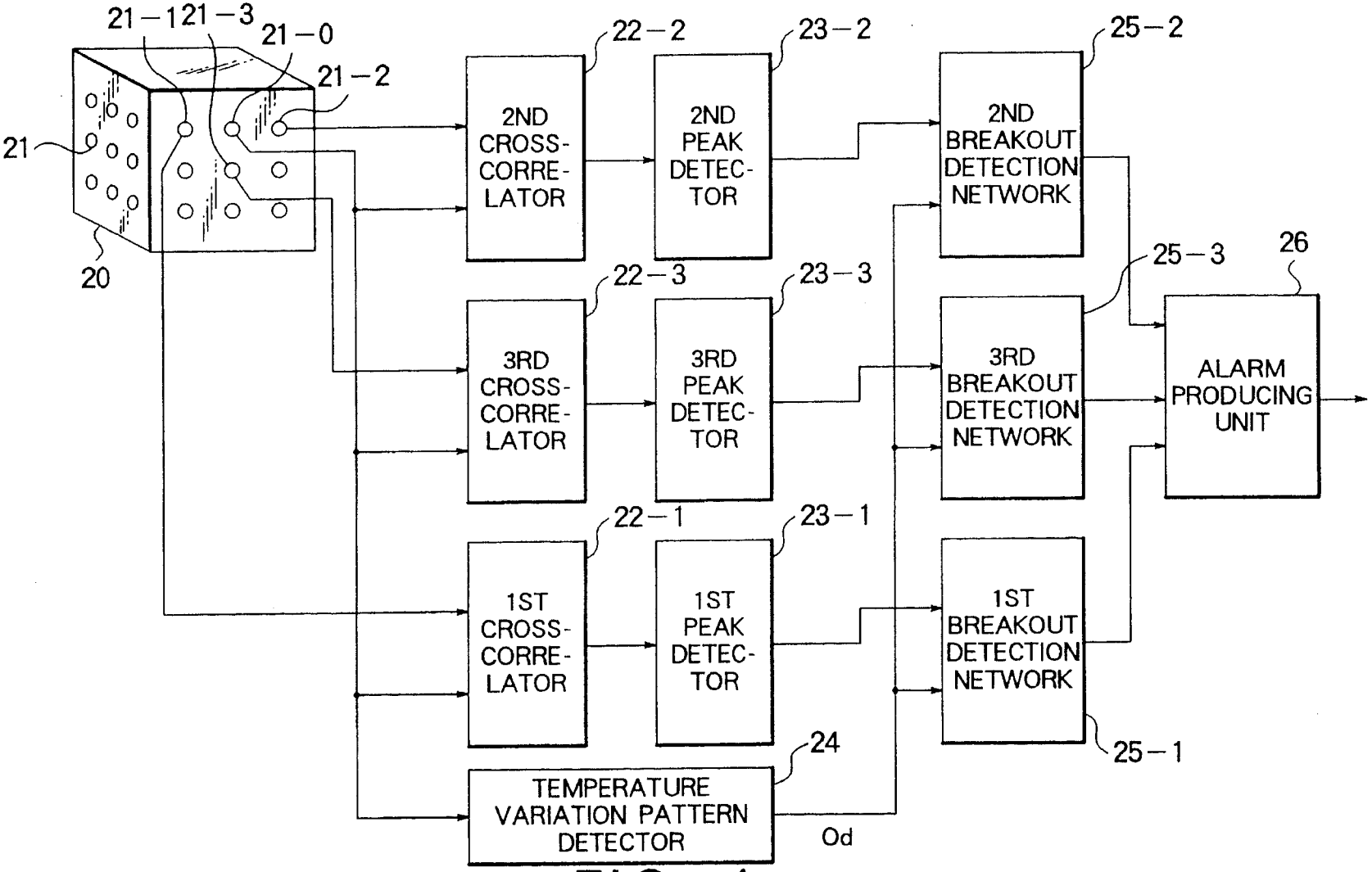
FIG. 4 is a block diagram of a minimum basic structure of a breakout prediction system according to one embodiment of this invention.

Referring to FIG. 4, a breakout prediction system according to one embodiment of this invention will be described. The breakout prediction system comprises a number of temperature sensors 21 implemented by thermocouple elements embedded in a wall of a mold 20 throughout an entire area of the wall at a space left from one another. For convenience of description, FIG. 4 illustrates, as a prediction deciding section, a minimum basic structure essential in carrying out breakout prediction. Specifically, among a number of the temperature sensors 21, one temperature sensor is selected as a central temperature sensor 21-0. A combination of the central temperature sensor 21-0, left and right temperature sensors 21-1 and 21-2 adjacent to the central temperature sensor 21-0 at a same level, and a lower temperature sensor 21-3 below the central temperature sensor 21-0 is collectively used as an operation unit. For convenience of description, the left, the right, and the lower temperature sensors 21-1, 21-2, and 21-3 will hereinafter be referred to as first through third temperature sensors, respectively. The prediction deciding section is connected to these temperature sensors 21-0 through 21-3 and carries out breakout prediction. The breakout prediction system includes a number of such combinations of the temperature sensors in a positional relationship as described above. In correspondence to those combinations, a plurality of the prediction deciding sections having the structure illustrated in FIG. 4 are provided.

The prediction deciding section comprises first through third cross-correlators 22-1 to 22-3, first through third peak detectors 23-1 to 23-3, a temperature variation pattern detector 24, first through third breakout detection networks 25-1 to 25-3, and an alarm producing unit 26. The first through the third cross-correlators 22-1 to 22-3 correspond to the first through the third temperature sensors 21-1 to 21-3, respectively, and are supplied with first through third temperature detection signals from the first through the third temperature sensors 21-1 to 21-3, respectively. In addition, the first through the third cross-correlators 22-1 to 22-3 are commonly supplied with a temperature detection signal from the central temperature sensor 21-0. The first through the third peak detectors 23-1 to 23-3 are connected to the first through the third cross-correlators 22-1 to 22-3, respectively, and detect peak values of outputs of the first through the third cross-correlators 22-1 to 22-3, respectively. The temperature variation pattern detector 24 is supplied with the temperature detection signal from the central temperature sensor 21-0. The first through the third breakout detection networks 25-1 to 25-3 are connected to the first through the third peak detectors 23-1 to 23-3, respectively, and supplied with outputs of the first through the third peak detectors 23-1 to 23-3, respectively. In addition, the first through the third breakout detection networks 25-1 to 25-3 are commonly supplied with an output of the temperature variation pattern detector 24. The alarm producing unit 26 is supplied with outputs of the first through the third breakout detection networks 25-1 to 25-3 and produces an alarm.

A detected temperature level detected by the central temperature sensor 21-0 is supplied to the temperature variation pattern detector 24 as time sequential data. It is noted here that the detected temperature level is detected at a given sampling period, for example, at every second. Let the detected temperature level detected at a particular or an i-th sampling period be represented by Td(i). In this event, a detected temperature level detected at an (i−1)-th sampling period (one sampling period before the particular sampling period) is represented by Td(i−1). Likewise, a detected temperature level detected at an (i−n)-th sampling period (n sampling periods before the particular sampling period) is represented by Td(i−n).

Figure 5:
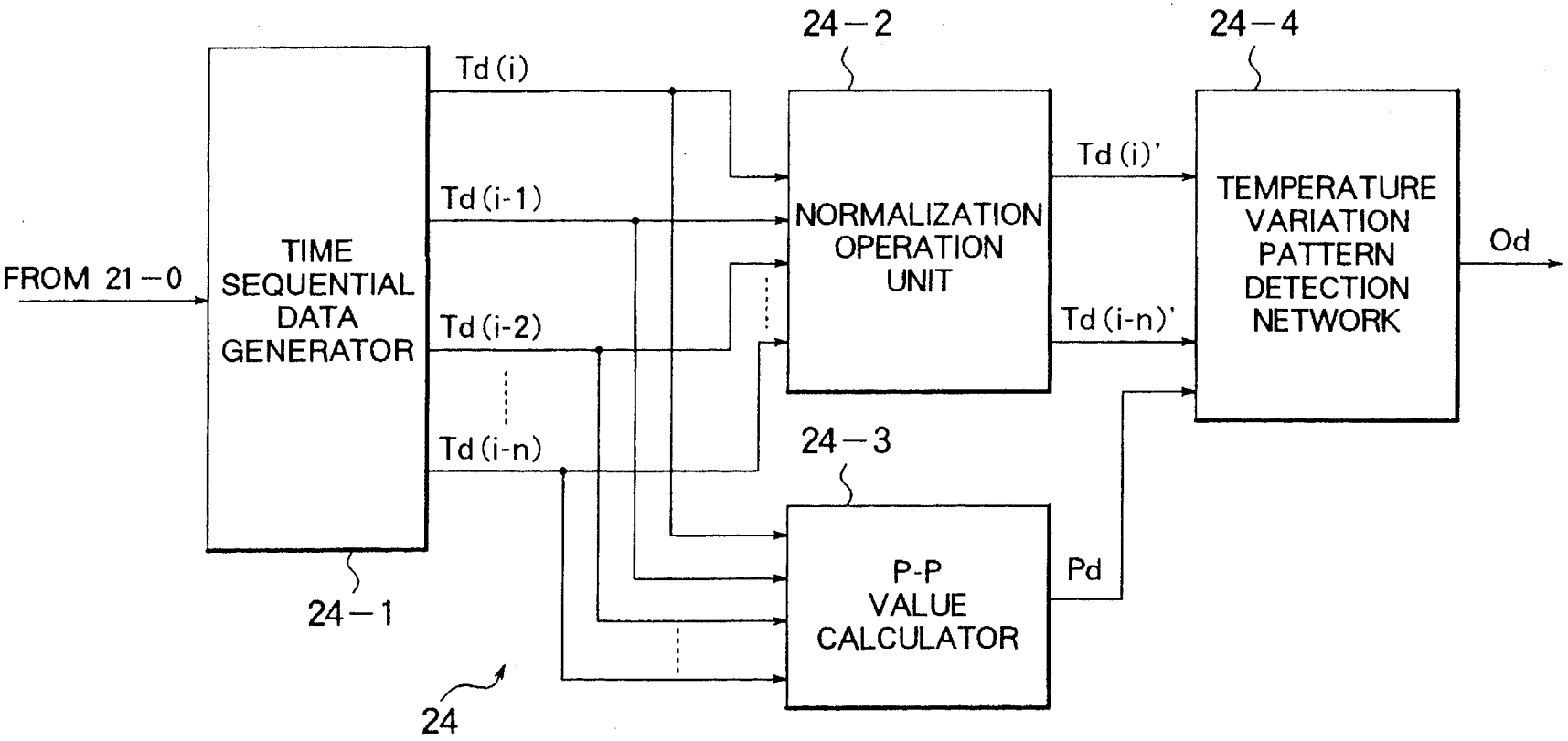
FIG. 5 is a block diagram of a structure of a temperature variation pattern detector illustrated in FIG. 4.

Referring to FIG. 5, the temperature variation pattern detector 24 will be described. The temperature variation pattern detector 24 comprises a time sequential data generator 24-1, a normalization operation unit 24-2, a P—P value calculator 24-3, and a temperature variation pattern detection network 24-4. Supplied with the detected temperature level from the central temperature detector 21-0, the time sequential data generator 24-1 generates time sequential data including the above-mentioned detected temperature levels Td(i) to Td(i−n), (n+1) in number. Using these detected temperature levels, (n+1) in number, the normalization operation unit 24-2 carries out a predetermined normalization operation, which will later be described, to produce normalization results Td(i)' to Td(i-n)', (n+1) in number. The P—P value calculator 24-3 carries out a calculation, which will later be described also, by the use of the detected temperature levels Td(i) to Td(i−n), (n+1) in number.

Specifically, the normalization operation unit 22-4 carries out the normalization operation represented by the following equations (1) through (3) to produce the normalization results Td(i)' to Td(i−n)'.

$$\overline{Td} = \frac{1}{n+1} \sum_{k=i-n}^{i} Td(k) \tag{1}$$

$$\sigma_d = \sqrt{\frac{1}{n+1} \sum_{k=i-n}^{i} (Td(k) - \overline{Td})^2} \tag{2}$$

$$Td(j)' = \frac{Td(j)\overline{Td}}{\sigma_d} \quad (j = i - n \text{ to } i) \tag{3}$$

On the other hand, the P—P value calculator 23-4 carries out the calculation represented by the following equation (4) to produce a difference Pd between a maximum value and a minimum value of the detected temperature levels Td(i) to Td(i−n).

$$Pd = \max(Td(i-n), \ldots, Td(i)) - \min(Td(i-n), \ldots, Td(i)) \tag{4}$$

The above-described normalization results Td(i)' to Td(i−n)' and the difference Pd are supplied to the temperature variation pattern detection network 24-4.

Figure 6:
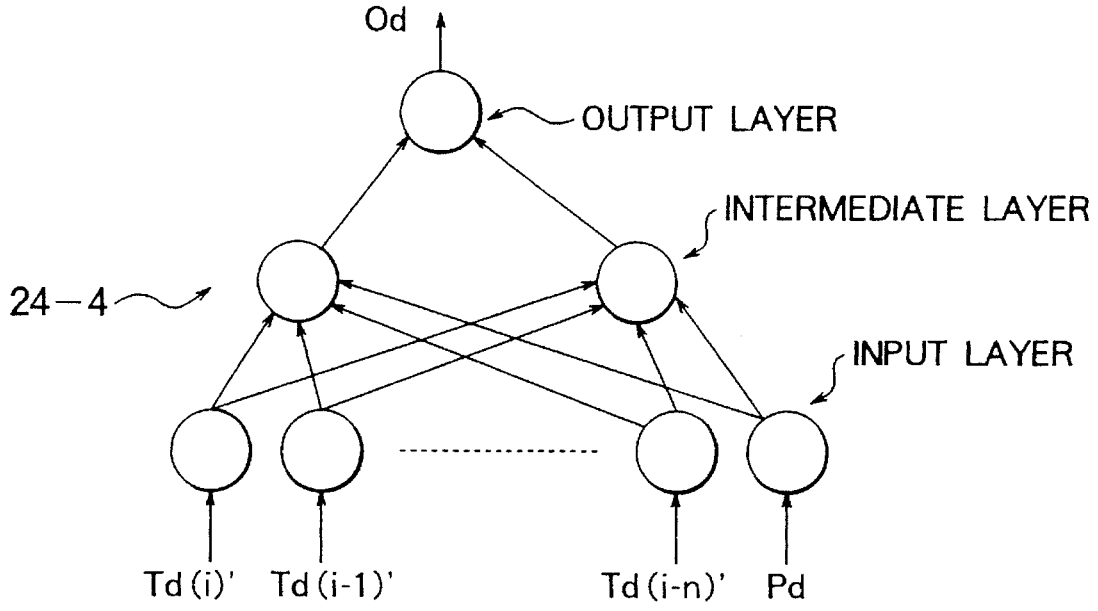
FIG. 6 is a view illustrating an example of a temperature variation pattern detection network illustrated in FIG. 5.

Referring to FIG. 6, the temperature variation pattern detection network 24-4 is implemented by a neural network comprising an input layer 31 including first through (n+2)-th units supplied with the normalization results Td(i)' through Td(i−n)' and the difference Pd, respectively, an intermediate layer 32 including a plurality of units, and an output layer 33 including a single unit. Through a learning process, the neural network learns or is trained to produce an output Od indicative of a "1" level when supplied with the temperature variation pattern illustrated in FIG. 3. Otherwise, the neural network produces the output Od indicative of a "0" level. Such a learning process will later be described.

Next, description proceeds to processing of the detected temperature levels detected by the central temperature sensor 21-0 and the first through the third temperature sensors 21-1 to 21-3 surrounding the central temperature sensor 21-0. Although the first through the third temperature sensors 21-1 to 21-3 surrounding the central temperature sensor 21-0 are shown in FIG. 4, following description is directed to processing of the detected temperature levels detected by the central temperature sensor 21-0 and the first temperature sensor 21-1 as a typical example. The similar processing is carried out for the detected temperature levels detected by the remaining temperature sensors. It is assumed here that the detected temperature levels detected by the first temperature sensor 21-1 are represented by Ta(i) to Ta(i–n) for the same sampling periods as those of the detected temperature levels Td(i) to Td(i–n) detected by the central temperature sensor 21-0, respectively.

The detected temperature levels detected by the central and the first temperature sensors 21-0 and 21-1 are supplied to the first cross-correlator 22-1. The first cross-correlator 22-1 carries out the following operation.

(1) Normalization Operation

By the use of the detected temperature levels detected by the central and the first temperature sensors 21-0 and 21-1, normalization operation similar to that carried out by the normalization operation unit 24-2 is executed to produce the normalization results Td(i)' to Td(i–n)' and Ta(i)' to Ta(i–n)'.

(2) Cross-Correlation Value Calculation

A cross-correlation value C(τ) is calculated in accordance with the following equation (5).

$$C(\tau)=\frac{1}{N+1}\sum_{j=i-N}^{i} Td(j)'\cdot Td(j+\tau)' \quad (5)$$

$$(\tau=-n \text{ to } n)$$

If the value k in Ta(k)' is out of a range between (i–n) and i:

$$Ta(k)'=0$$

The first cross-correlator 22-1 produces, as an output, the cross correlation value C(τ) which is supplied to the first peak detector 23-1 at a following stage. The first peak detector 23-1 produces a value $\tau_{max}$ corresponding to a maximum value of the cross correlation value C(τ) ($-n \leqq \tau \leqq n$).

Figure 7:
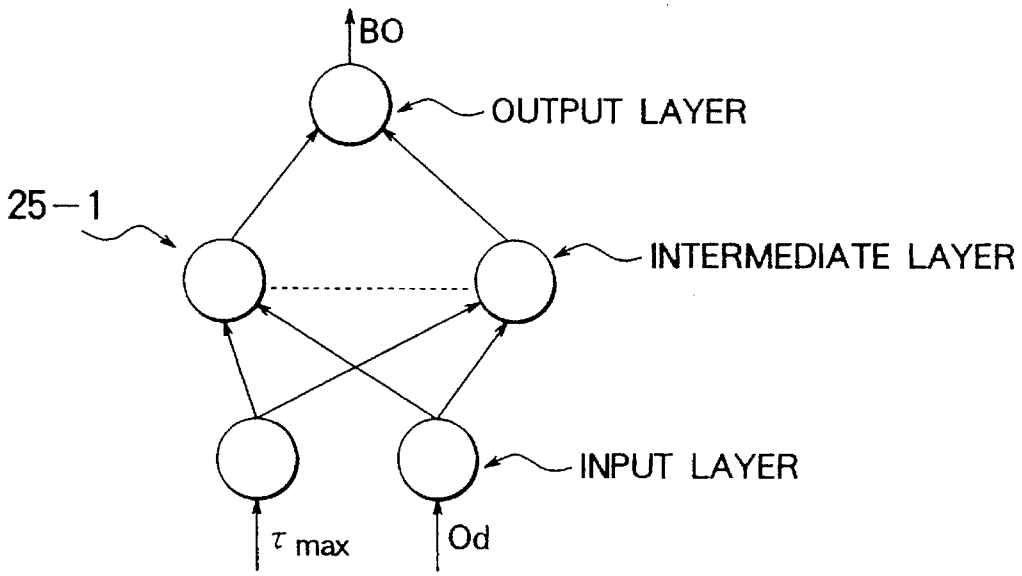
FIG. 7 is a view illustrating an example of a breakout detection network illustrated in FIG. 4.

Referring to FIG. 7, the first breakout detection network 25-1 has a network structure which comprises an input layer 41 including two units supplied with the output $\tau_{max}$ of the first peak detector 23-1 and the output Od of the temperature variation pattern detector 24, respectively, an intermediate layer 42 including a plurality of units, and an output layer 43 including a single unit. The first breakout detection network 25-1 is supplied with the output $\tau_{max}$ and the output Od of the temperature variation pattern detector 24 and learns, through the learning process, to produce a detection result BO indicative of a "1" level upon occurrence of breakout and to otherwise produce the detection result BO indicative of a "0" level.

The learning process for the temperature variation pattern detection network 24-4 and the first breakout detection network 25-1 is carried out in the manner which will presently be described.

(A) Collection of Breakout Data

As described above, two kinds of the temperature variation patterns illustrated in FIG. 3 are observed at the adjacent temperature sensors as a predictive sign of the breakout. In view of the above, temperature transition data upon occurrence of breakout are preliminarily collected for every temperature sensors and stored in a memory which is not shown in the figure. Also, the data upon absence of breakout are collected.

(B) Learning Process for the Networks

In each of the temperature variation pattern detection network and the breakout detection network, a predetermined calculation is carried out. For example, such calculation is disclosed in a book entitled "Fundamental Theory of Neuro-Computing" published by Kaibundo Publishing Co., Ltd. (edited by Japan Technology Transfer Association, Technical Committee on Neuro-Computer), pp. 2 and 3. Using the data collected as described in the above item (A) and the information indicating whether or not the data correspond to occurrence of the breakout, these networks are made to preliminary learn in the manner described in pages 4 to 7 of the above-mentioned reference. Upon misjudgement, those data are incorporated into the above-mentioned collected data in order to repeat the learning process of the networks.

Next, the alarm producing unit 26 (FIG. 4) is supplied with the prediction results BO produced by the first through the third breakout detection networks 25-1 to 25-3. When one or more prediction results exceed a predetermined threshold value (for example, 0.6), an alarm is produced.

As described above, by monitoring the temperature variation pattern of the surface of the mold resulting from presence of the cracked portion in the shell within the mold, it is possible to immediately predict occurrence of the breakout. It is also possible to improve the precision in prediction through a repetition of the learning process by the use of the temperature variation pattern upon misjudgement of prediction.

Specifically, when the shell is cracked in the mold, the cracked portion is propagated with the drawing operation of the strand. As a consequence, temperature ascending pattern and a temperature descending pattern are observed in a surface temperature of the surrounding area after a certain delay. According to this invention, it is possible to accurately detect this delay by the use of the cross-correlators. The delay is different in dependence upon the positional relationship of the temperature sensors. By learning the above for every central temperature sensor, the precision in prediction can be improved.

Furthermore, by providing the peak detectors at the following stage of the cross-correlators, the structure of the breakout detection network can be simplified. This reduces the calculation time so that the system is adapted to real-time judgement.

Although the foregoing description has been directed to the case where one of temperature sensors and three adjacent temperature sensors are used as a single unit, it will be understood that a greater number of the adjacent temperature sensors can be included in such a single unit. In that event, the prediction deciding section includes the corresponding number of cross-correlators, peak detectors, and breakout detection networks.

What is claimed is:

1. A breakout prediction system for predicting breakout in a mold of a continuous casting machine with reference to detection signals produced from a plurality of temperature sensors located on said mold, wherein:

said temperature sensors are grouped into a plurality of units each of which comprises one of said temperature sensors and at least three adjacent temperature sensors adjacent to the one of said temperature sensors;

each unit being connected to a corresponding one of a plurality of prediction deciding sections;

each prediction deciding section comprising:

at least three cross-correlators which correspond to said at least three adjacent temperature sensors, respectively, and each of which is responsive to a detection signal from a corresponding one of said adjacent temperature sensors and a detection signal from the one of said temperature sensors and carries out a predetermined normalization operation and a cross-correlation operation to produce an operation result;

a temperature variation pattern detector supplied with the detection signal from the one of said temperature sensors for detecting a temperature variation pattern indicative of a time sequential variation of a temperature;

at least three peak detectors which are connected to said at least three cross-correlators, respectively, and each of which is for detecting a peak value of said operation result; and at least three breakout detection networks each of which is supplied with an output of a corresponding one of said at least three peak detectors and an output of said temperature variation pattern detector and carries out decision on breakout prediction;

said system further comprising an alarm producing unit for producing an alarm when one of outputs of said at least three breakout detection networks exceeds a predetermined threshold level.

2. A breakout detection system as claimed in claim 1, wherein said temperature variation pattern detector comprises:

means for obtaining, as time sequential data, a plurality of detected temperature levels in response to a detection signal from the one of said temperature sensors;

a normalization operation unit for carrying out a predetermined normalization operation upon said plurality of detected temperature levels to produce a plurality of normalization results;

a calculation unit for calculating a difference between a maximum value and a minimum value of said plurality of detected temperature levels; and a temperature variation pattern detection network supplied with said plurality of normalization results and said difference for detecting a temperature variation pattern through a neural network.

* * * * *